US009593523B1

(12) United States Patent
Trimble et al.

(10) Patent No.: US 9,593,523 B1
(45) Date of Patent: Mar. 14, 2017

(54) SYSTEM AND METHOD FOR PREVENTING/MITIGATING THEFT FROM A CONTAINER, SUCH AS A SAFE

(71) Applicant: Second Safe LLC, Atlanta, GA (US)

(72) Inventors: Kevin T. Trimble, Atlanta, GA (US); Benjamin Lockhart, Atlanta, GA (US)

(73) Assignee: SECOND SAFE LLC, Atlanta, GA (US)

( * ) Notice: Subject to any disclaimer, the term of this patent is extended or adjusted under 35 U.S.C. 154(b) by 0 days.

(21) Appl. No.: 14/474,208

(22) Filed: Sep. 1, 2014

Related U.S. Application Data

(60) Provisional application No. 61/872,235, filed on Aug. 30, 2013.

(51) Int. Cl.

| | |
|---|---|
| ***E05G 1/02*** | (2006.01) |
| ***E05G 1/06*** | (2006.01) |
| ***E05G 1/14*** | (2006.01) |
| ***A47B 88/22*** | (2006.01) |
| ***A47B 81/00*** | (2006.01) |
| ***E05B 73/00*** | (2006.01) |

(52) U.S. Cl.
CPC ..... *E05G 1/14* (2013.01); *A47B 81/00* (2013.01); *A47B 88/22* (2013.01); *E05B 73/00* (2013.01); *E05G 1/02* (2013.01); *E05G 1/06* (2013.01)

(58) Field of Classification Search
CPC .... E05G 1/14; E05G 1/06; E05G 1/08; E05G 1/02; A47B 17/04; A47B 88/22; A47B 81/00; Y10S 206/818; Y10S 70/81; A47F 3/002; A47F 7/024; E05B 73/00
USPC ..... 109/53–57; 211/88.01; 312/204; 220/23.89, 23.87, 23.86, 23.83
See application file for complete search history.

(56) References Cited

U.S. PATENT DOCUMENTS

| | | | | | |
|---|---|---|---|---|---|
| 428,941 | A | * | 5/1890 | Pauly, Sr. | 312/217 |
| 513,061 | A | * | 1/1894 | Slater | 312/204 |
| 535,782 | A | * | 3/1895 | Woodruff | 312/217 |
| 1,161,189 | A | * | 11/1915 | Coleston | A47F 3/005 109/54 |
| 1,247,367 | A | * | 11/1917 | Burchell | 312/204 |
| 1,347,693 | A | * | 7/1920 | Garfinkel | 109/47 |
| 1,528,618 | A | * | 3/1925 | Knaster | 312/204 |
| 1,554,900 | A | * | 9/1925 | Baer | 109/54 |
| 1,869,302 | A | * | 7/1932 | Brosnan | 232/4 R |

(Continued)

*Primary Examiner* — Lloyd Gall
*Assistant Examiner* — Amanda L Miller
(74) *Attorney, Agent, or Firm* — Smith Tempel; Steven P. Wigmore

(57) ABSTRACT

A system and method for mitigating theft from a container includes a container having a plurality of walls defining a first volume and an anti-theft mitigation device having a plurality of walls defining a second volume. A fastening mechanism is attached to the anti-theft mitigation device such that the antitheft mitigation device may be coupled to the container by the fastening mechanism. The second volume of the anti-theft mitigation device is substantially smaller than the first volume of the container. The anti-theft mitigation device may be positioned within the first volume and may appear to define a portion of the first volume of the container. The fastening mechanism may comprise at least one of a magnet, a hook and loop fastener, a screw, a nail, a rivot, a snap, a mating protuberance, a channel-containing structure, a mating male or female mechanical structure.

10 Claims, 9 Drawing Sheets

(56) References Cited

U.S. PATENT DOCUMENTS 2,589,349 A * 3/1952 Diefenbach ..... A45C 11/32 131/241
2,667,396 A * 1/1954 Liggett ..... 312/248
3,899,983 A * 8/1975 Hernandez ..... 109/54
4,113,332 A * 9/1978 McMaster ..... 312/204
4,172,424 A * 10/1979 de Palau ..... 109/50
4,211,382 A * 7/1980 Bonfils ..... A47G 1/168 248/467
4,252,387 A * 2/1981 Wagner ..... 312/204
4,387,534 A * 6/1983 Lewandowski et al. ..... 47/66.6
4,638,618 A * 1/1987 Iesaka ..... B44C 1/28 52/36.4
4,736,853 A * 4/1988 O'Mara ..... A45C 11/00 206/224
4,751,885 A * 6/1988 Squire ..... E05G 1/00 109/51
4,901,651 A * 2/1990 Herron ..... 109/54
4,941,718 A * 7/1990 Alexander et al. ..... 312/312
4,979,323 A * 12/1990 Wenkman ..... A47G 1/142 40/597
5,048,901 A * 9/1991 DeBlaay ..... 312/204
5,066,079 A * 11/1991 Lawrence ..... 312/204
D322,526 S * 12/1991 Leis ..... D6/661
5,141,300 A * 8/1992 Ciesla ..... 312/204
D344,654 S * 3/1994 McCrudden ..... D6/513
5,367,278 A * 11/1994 Yoshikawa ..... H01F 7/0268 206/818
5,373,654 A * 12/1994 Whalen ..... A47G 1/06 312/245
5,927,111 A * 7/1999 Nachbauer ..... F16K 35/10 137/382
6,059,388 A * 5/2000 Wheatley, Jr. ..... 312/246
6,357,843 B1 * 3/2002 Keller ..... A47G 1/0616 312/183
6,390,361 B1 * 5/2002 Gund ..... 235/7 R
6,540,601 B2 * 4/2003 Nottingham et al. ..... 453/3
7,261,385 B2 * 8/2007 Weinberger ..... 312/330.1
7,540,175 B2 * 6/2009 Kalous ..... E05G 1/005 109/50
D668,080 S * 10/2012 Doron ..... D6/661
8,506,023 B2 * 8/2013 Goldie ..... 312/204
8,764,131 B2 * 7/2014 Risley ..... 312/204
2008/0211362 A1 * 9/2008 Moll ..... A47B 88/22 312/204
2010/0083548 A1 * 4/2010 Reis ..... A47G 1/0605 40/711
2010/0148896 A1 * 6/2010 Hugo ..... H01F 7/0221 335/285
2011/0042542 A1 * 2/2011 Russo ..... A47G 1/17 248/467
2014/0061409 A1 * 3/2014 Mayhew, Jr. ..... F16M 13/02 248/206.5

* cited by examiner

SYSTEM AND METHOD FOR PREVENTING/MITIGATING THEFT FROM A CONTAINER, SUCH AS A SAFE

DESCRIPTION OF THE RELATED ART

Retail and commercial establishments/organizations continue to be concerned about losses due to theft. Typically, to deter theft, retail and commercial establishments will make frequent drops or physical deposits in a safe, where cash, checks, or charge slips are positioned in an upper portion of the safe.

The practice/location of the drops within safes has become so common that thieves are now increasingly targeting the contents of the safe rather than cash held at the initial point of customer contact, such as at a cash register. Moreover, it is known that safes may house further valuable assets beyond cash/currency, which may be the target of theft and/or robbery.

While safes provide a first line of defense against theft, there is a need for a method and system to deter/mitigate theft when a safe is opened or when a risk exists due to having the contents of a safe exposed.

SUMMARY OF THE DISCLOSURE

A system and method for mitigating theft from a container includes a container having a plurality of walls defining a first volume and an anti-theft mitigation device having a plurality of walls defining a second volume. A fastening mechanism is attached to the anti-theft mitigation device such that the antitheft mitigation device may be coupled to the container by the fastening mechanism. The second volume of the anti-theft mitigation device is substantially smaller than the first volume of the container. The anti-theft mitigation device may be positioned within the first volume and may appear to define a portion of the first volume of the container.

The fastening mechanism may comprise at least one of a magnet, a hook and loop fastener, a screw, a nail, a rivot, a snap, a mating protuberance, a channel-containing structure, a mating male or female mechanical structure.

The anti-theft mitigation device may have a plurality of walls and only a single opening. The anti-theft mitigation device may have a cross-sectional geometry comprising at least of a rectangular shape and a triangular shape.

The container may comprise at least one of as a cabinet, a closet, a desk, a piece of furniture with a drawer, and a storage container having a door.

In other embodiments, the container may comprise at least one of a vault, a portable safe, a reinforced-fireproof cabinet, a document safe, a pawn drawer system, an in-floor safe, a wall safe, a jewelry safe, and a gun safe.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same Figure. Letter character designations for reference numerals may be omitted when it is intended that a reference numeral to encompass all parts having the same reference numeral in all Figures.

DETAILED DESCRIPTION

The word "exemplary" is used herein to mean "serving as an example, instance, or illustration." Any aspect described herein as "exemplary" is not necessarily to be construed as preferred or advantageous over other aspects.

Figure 1:
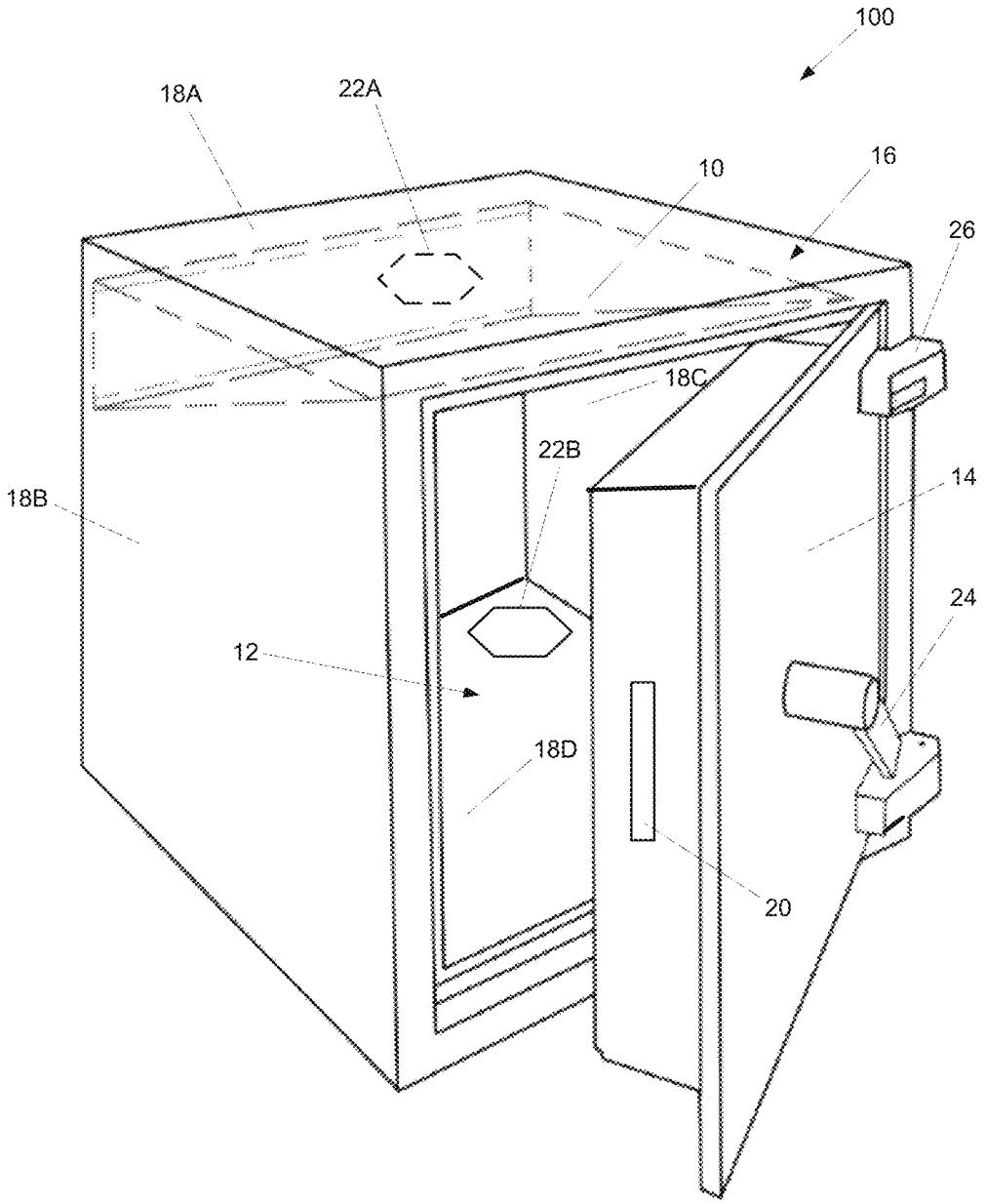
FIG. 1 illustrates one exemplary embodiment of a system for mitigating theft from a container, such as a safe.

FIG. 1 illustrates one exemplary embodiment of a system 100 for mitigating theft from a large container 16, such as a safe. The system 100 may comprise a large container 16, like a safe, and an anti-theft mitigation device 10. While it is contemplated that the large container 16 will typically comprise a security safe, one of ordinary skill in the art will recognize that other large containers for housing assets 22 may be substituted without departing from the scope and spirit of this disclosure. For example, other large containers 16 include, but are not limited to, cabinets, desks drawers, closets, and the like.

The large container 16 may contain assets 22 which have been illustrated with two hexagons in FIG. 1. One or more assets 22A represented by the first hexagon may comprise one or more high-value assets while the second one or more assets 22B represented by second hexagon may comprise one or more assets having a value which is lower compared to the first asset or assets 22A. However, in other exemplary embodiments, the two sets of assets 22 may comprise equivalent value if desired. Assets 22 may include, but are not limited to, cash (currency), precious gems, controlled substances, sensitive documents, firearms, chemicals, objects (i.e. artwork), electronics, etc.

The first asset 22A may be contained within the large container 16 as well as the anti-theft mitigation device 10. Meanwhile, the second asset 22B may only be contained by the large container 16 and may be visible when the door 14 to the large container 16 is opened as illustrated in FIG. 1. The first asset 22A is not visible since it is hidden from view by the anti-theft mitigation device 10.

Specifically, the first asset 22A contained within an interior region or volume defined by the anti-theft mitigation device 10 where the device 10 is also within the interior or volume defined by the large container 16 may not be visible to an operator when the door 14 is opened. When the door 14 to the large container 16 is opened, the anti-theft mitigation device 10 appears to be part of a bulkhead and/or an upper wall 18A of the larger container 16. With the first asset 22A not being visible to the operator when the door 14 is opened, this decreases or mitigates the risk that an unauthorized operator, i.e., a thief/burglar, robber, will discover that the first asset 22A exists.

While the position of the anti-theft mitigation device 10 is shown to be on an upper wall 18A within the interior or volume defined by the larger container 16, it is apparent to one of ordinary skill the art that the anti-theft mitigation device 10 may be positioned on any other interior wall of the larger container 16 such as interior sidewalls 18B, 18C as well as the bottom interior wall 18D of the larger container 16. The anti-theft mitigation device 10 has one or more fastening mechanisms 206 which may be used to attach the anti-theft mitigation device 10 to any interior wall of the larger container 16. Further details of the fastening mechanisms 206 for the anti-theft mitigation device 10 will be described below in connection with FIGS. 2-13.

As noted above, the larger container 16 may comprise any type of container as understood by one of ordinary skill the art. In the exemplary embodiment illustrated in FIG. 1, the container 16 comprises a security safe. In such exemplary embodiments, the container 16 may further comprise a security door 14 secured to the container 16 by door fastening mechanisms 26. The security door 14 may comprise a handle 24 that may open and close a locking mechanism 20.

The locking mechanism 20 has been represented with a rectangle in FIG. 1. The locking mechanism 20 may comprise a lock which may be opened with a key (not illustrated) such as, but not limited to, a warded lock, pin tumbler lock, wafer tumbler lock, disc tumbler lock or abloy lock, a tubular lock, and a lever tumbler lock. The locking mechanism 20 may also comprise a lock that does not use a physical key such as a combination type lock. Other types of locks include, but are not limited to, a chamber lock, a cylinder lock, an electronic lock, an electric strike, a magnetic lock, a mortise lock, a keycard lock, a magnetic keyed lock, a padlock, an RFID lock, a time lock, a biometric-activated lock, and any combination thereof.

The locking mechanism 20 is designed to lock and keep the door 14 in a closed position until the locking mechanism 20 is opened by an operator. When the door 14 of the larger container 16 is opened, the interior region 12 of the larger container 16 may be accessed. The interior region 12 of the larger container 16 may contain the anti-theft mitigation device 10 which houses the first asset 22A as well as the second asset 22B which may be visible when the door 14 is opened.

The container 16 may comprise any type of safe, such as, but not limited to, room-sized fireproof vaults, such as a bank vault, fire-resistant safes, reinforced-fireproof cabinets, data and document safes, in-floor safes, wall safes, jewelry safes, pawn safes having multiple drawers, and gun safes. As noted previously, the container 16 is not limited to safes and may comprise any type of container such as a cabinet, a closet, a desk, any type of furniture or storage container with drawers, doors, and the like. In some instances, the larger container 16 may not comprise any locking mechanism 20 as understood by one of ordinary skill the art. The container 16 made be made from various materials and with combinations of materials. Exemplary materials for the container 16 may include, but are not limited to, metal, wood, plastic, ceramics, cement, etc.

One advantage of the anti-theft mitigation device 10 is that it typically has a geometry in which an operator opening the container 16 would not think/infer the anti-theft mitigation device 10 is hollow and that it may contain an asset 22A. The geometry of the anti-theft mitigation device 10 is usually such that it appears to be an extension and/or part of the container 16 when the door 14 is open relative to the interior region 12. In a sense, because of its materials, size, and shape, the anti-theft mitigation device 10 is "camouflaged" relative to the interior of the container 16.

Further, the volume occupied by the anti-theft mitigation device 10 usually has a magnitude which is less than the volume of the interior region 12 defined by the container 16. Additionally, the exterior materials of the anti-theft mitigation device 10 are selected such that they substantially match and/or are identical to the materials used to form the interior of the larger container 16.

When attached to the large container 16 as shown in FIG. 1, the anti-theft mitigation device 10 is configured to provide the operator with an impression (appearance) that the device 10 forms a portion of the interior region 12 of the container 16. "Interior region" means any portion within the container 16 wherein an asset 22 may be stored. When the anti-theft mitigation device 10 is attached or otherwise secured to a portion of the interior region 12 of the larger container 16, the contents, which may include the asset 22A, of the container 16 are hidden from plain sight of potential thieves or other viewers of the interior region 12.

Figure 2:
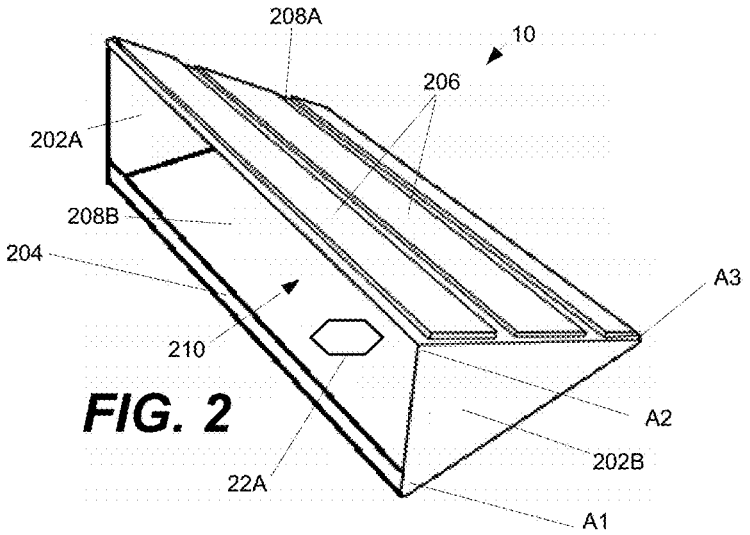
FIG. 2 illustrates one exemplary embodiment of a perspective view of an anti-theft mitigation device that may be part of the system for mitigating theft from a container, such as a safe.

FIG. 2 illustrates one exemplary embodiment of a perspective view of an anti-theft mitigation device 10 that may be part of the system 100 for mitigating theft from a container 16, such as a safe, as illustrated in FIG. 1. The anti-theft mitigation device 10 may comprise a "wedge"-like or "prism"-like outer geometry according to this exemplary embodiment.

As illustrated in FIG. 2, the wedge-like shape for this exemplary embodiment may comprise first and second triangularly shaped walls 202A, 202B and two rectangularly shaped walls 208A, 208B. These four walls 202, 208 define an opening 210 that allows access to an internal cavity/volume within the wedge-like shape.

One of the rectangular shaped walls 208A may comprise one or more fastening mechanisms 206 for coupling the anti-theft mitigation device 10 to an interior region 12 of the larger container 16. According to one exemplary embodiment, the one or more fastening mechanisms 206 may comprise strip magnets when the larger container 16 is made from metals that easily couple to magnets. According to the exemplary embodiment illustrated in FIG. 2, three strip magnets form the fastening mechanisms 206. However, the number and size of the fastening mechanisms may be varied without departing from the scope and spirit of this disclosure. Other fastening mechanisms 206 are possible and are included within the scope of this disclosure. Other fastening mechanisms 206 are described below in connection with FIG. 6.

Projecting from the second rectangular wall 208B is a lip or short wall 204. This lip or short wall 204 may prevent an asset 22 from sliding out of the interior region or volume of the wedge-like shaped volume when the anti-theft mitigation device 10 is coupled to one of the walls 18 of the larger container 16, such as illustrated in FIG. 1. The height of the lip or short wall 204 may be modified without departing from the scope and spirit of this disclosure. That is, the height of the lip or short wall 204 may be increased or decreased depending on the types of assets 22 which are stored within the volume defined by the anti-theft mitigation device 10.

The anti-theft mitigation device 10 may be constructed using one or more materials. According to one exemplary embodiment, each of the walls 202, 204, and 208 may be made from a material such as metal. However, other materials and combinations of materials may be used without departing from the scope and spirit of this disclosure. Other materials include, but are not limited to, wood, cement, ceramics, glass, composites, polymers (i.e. plastics), and any combination thereof. To provide the appearance that the anti-theft mitigation device is part of the container 16, the device 10 typically has the same color, texture, and material as at least the interior housing of the container 16.

As illustrated in FIG. 2, each triangular sidewall 202, may comprise a scalene right triangle which has an angle A2 of approximately 90.0° and two other angles A1, A3 which are acute and are less than 90°, such as, but not limited to 30.0°. However, other types of triangular shapes are possible and are included within the scope of this disclosure.

When the angle A2 of each sidewall 202 comprises a magnitude of approximately 90°, this means that the corner having the sides/lines which form this angle A2 may substantially mirror the shape of the container 16 when the container 16 comprises walls 18 that are joined together at 90° angles. When the container 16 comprises walls 18 joined together at 90° angles, the opening 210 to the anti-theft mitigation device 10 may be sealed or closed by a corresponding wall 18 of the container such as illustrated in FIG. 1 described above.

Figure 3:
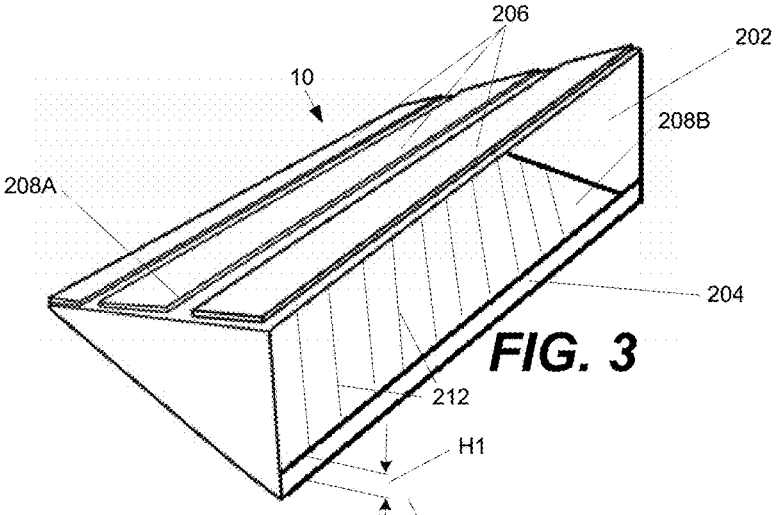
FIG. 3 illustrates another exemplary embodiment of the perspective view of an anti-theft mitigation device that may be part of the system for mitigating theft from a container, such as a safe.

Referring now to FIG. 3, this figure illustrates another exemplary embodiment of a perspective view of an anti-theft mitigation device 10 that may be part of the system 100 for mitigating theft from a container 16, like a safe. The exemplary embodiment illustrated in FIG. 3 is similar to the exemplary embodiment illustrated in FIG. 2. Therefore, only the differences between these two exemplary embodiments will be described below.

According to this exemplary embodiment of FIG. 3, one of the rectangular walls 208B may be provided with a material or coating 212 for reducing or eliminating direct contact between an asset 22 and the rectangular wall 208B. The material or coating 212 may comprise at least one of a cloth material, a plastic film, a rubber film, and the like in order to reduce or eliminate direct contact between an asset 22 and the rectangular wall 208B.

The material or coating 212 may be helpful for those assets 22, such as an object or piece of art, which may be damaged or injured if the asset 22 rubs/slides against the rectangular wall 208B, especially when the rectangle wall 208B is constructed from a hard material such as metal.

In the exemplary embodiment illustrated in FIG. 3, a height H1 is provided for the lip or short wall 204. According to one exemplary embodiment, the height H1 may comprise a magnitude between approximately 0.25 of an inch to several inches, and usually a magnitude which is less than one of the dimensions of the side walls 202. Other magnitudes for the height H1 are possible and are within the scope of this disclosure.

Figure 4:
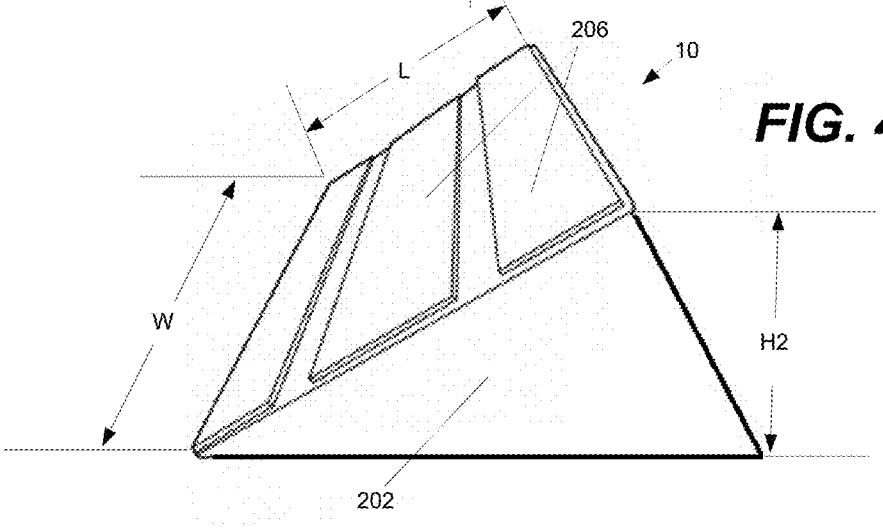
FIG. 4 illustrates a side view of an anti-theft mitigation device that may be part of the system for mitigating theft from a container, such as a safe.

Referring now to FIG. 4, this figure illustrates a side view of an anti-theft mitigation device 10 that may be part of the system 100 for mitigating theft from a container 16, such as a safe. The exemplary embodiment illustrated in FIG. 4 is similar to the exemplary embodiment illustrated in FIG. 3. Therefore, only the differences between these two exemplary embodiments will be described below.

According to this exemplary embodiment, the dimensions for the anti-theft mitigation device 10 are provided and which may include a length dimension L, a width dimension W, and a height dimension H2. The width dimension W generally has a magnitude which matches or is very close to the internal width of the container 16. In this way, the anti-theft mitigation device 10 will have a "look" or an appearance that the structure is integral with an interior wall 18 of the container 16. According to one exemplary embodiment, the width dimension W may have a magnitude that is between about 5.0 inches to about 30.0 inches.

Meanwhile, the height dimension H2 may have a magnitude that is between about 2.0 inches to about 8.0 inches. The length dimension L may have a magnitude that is between about 4.0 inches to about 16.0 inches. One of ordinary skill the art recognizes that other magnitudes for these dimensions are possible and are included within the scope of this disclosure. With these exemplary dimensions noted above, the anti-theft mitigation device 10 may define an internal volume having a magnitude between approximately 200.0 cubic inches to approximately 400.0 cubic inches.

Figure 5:
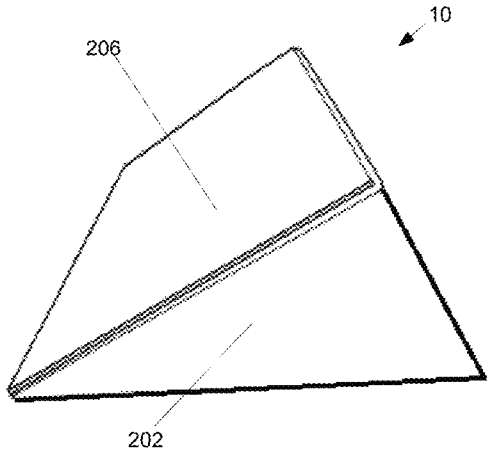
FIG. 5 illustrates another exemplary embodiment of an anti-theft mitigation device that may be part of the system for mitigating theft from a container, such as a safe.

FIG. 5 illustrates another exemplary embodiment of an anti-theft mitigation device 10 that may be part of the system 100 for mitigating theft from a container, such as a safe. The exemplary embodiment illustrated in FIG. 5 is similar to the exemplary embodiment illustrated in FIG. 4. Therefore, only the differences between these two exemplary embodiments will be described below.

According to this exemplary embodiment of FIG. 5, the fastening mechanism 206 comprises a single, substantially planar (flat) magnet that covers an entire surface of the anti-theft mitigation device 10. That is, the fastening mechanism 206 in this exemplary embodiment has a surface area which is substantially equal to or equivalent to the surface area of one of the sides of the anti-theft mitigation device 10. The fastening mechanism 206 may be coupled to the side of the anti-theft mitigation device 10 with an adhesive. When the container 16 is constructed from metal, the fastening mechanism 206 comprising the magnet will coupled to the container 16 due to its magnetic force as understood by one of ordinary skill the art.

Figure 6A:
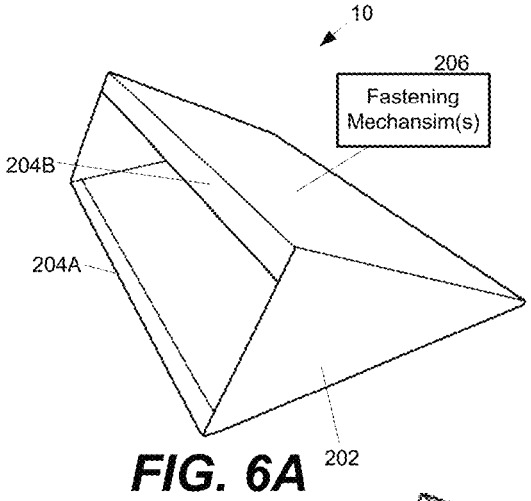
FIG. 6A illustrates a perspective view of the anti-theft mitigation device that may be part of a system for mitigating theft from a container, such as a safe.

Referring now to FIG. 6A, this figure illustrates a perspective view of the anti-theft mitigation device 10 that may be part of a system 100 for mitigating theft from a container 16, such as a safe. The exemplary embodiment illustrated in FIG. 6A is similar to the exemplary embodiment illustrated in FIG. 3. Therefore, only the differences between these two exemplary embodiments will be described below.

According to this exemplary embodiment of FIG. 6A, one side of the anti-theft mitigation device 10 comprises two lips or short walls 204. Specifically, a first lower lip 204A may be present on a same side as a second upper lip 204B. The heights of these two lips 204 may be substantially equal or they may be different. According to the exemplary embodiment illustrated in FIG. 6A, the lower lip 204A has a height magnitude which is less than the height magnitude of the second upper lip 204B. As noted previously, these lips 204 may help prevent assets 22 from sliding out of the anti-theft mitigation device 10 when it is coupled to a container 16.

In this exemplary embodiment, the fastening mechanism 206 has been represented by a functional rectangular box to indicate that any type of fastening mechanism may be employed with the anti-theft mitigation device 10 without departing from the scope of this disclosure. Exemplary fastening mechanisms 206 include, but are not limited to, magnets, hook and loop fasteners sold under the trademark VELCRO™, screws, nails, rivot, snaps, mating protuberance/channel-containing structures, mating male/female structures, and the like. The fastening mechanism 206 may comprise a hinge and hook system so that the anti-theft mitigation device 10 may rotate around the hinge when the hook is disengaged, where the hinge and hook are coupled to one side of an interior of the container 16.

Figure 6B:
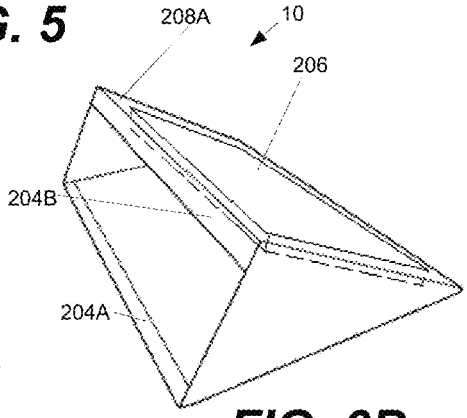
FIG. 6B illustrates a perspective view of the anti-theft mitigation device that may be part of a system for mitigating theft from a container, such as a safe.

FIG. 6B illustrates a perspective view of the anti-theft mitigation device 10 that may be part of a system 100 for mitigating theft from a container 16, such as a safe. The exemplary embodiment illustrated in FIG. 6B is similar to the exemplary embodiment illustrated in FIG. 3. Therefore, only the differences between these two exemplary embodiments will be described below.

According to this exemplary embodiment, the anti-theft mitigation device 10 may comprise two lips or short walls 204A, 204B similar to FIG. 6A. The fastening mechanism 206 may also comprise a single, substantially planar magnet which is flush mounted relative to side 208A. That is, side 208A may be provided with a recessed region which may receive the fastening mechanism 206 which has a thickness. The recessed region with inside 208A may have a depth which is substantially equal to or equivalent to the thickness of the fastening mechanism 206.

Figure 6C:
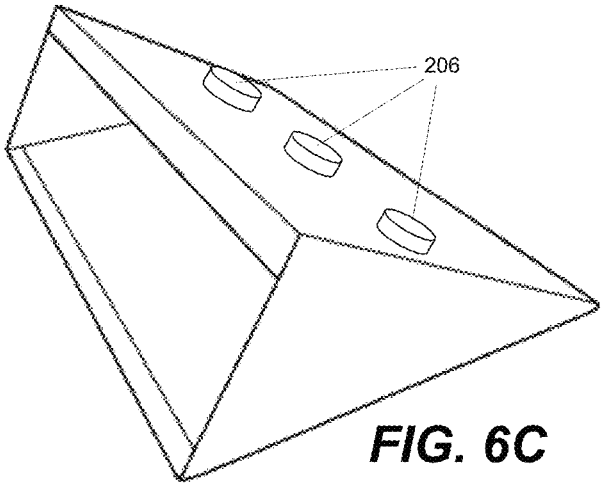
FIG. 6C illustrates a perspective view of the anti-theft mitigation device that may be part of a system for mitigating theft from a container, such as a safe.

FIG. 6C illustrates a perspective view of the anti-theft mitigation device 10 that may be part of a system 100 for mitigating theft from a container 16, such as a safe. The exemplary embodiment illustrated in FIG. 6C is similar to the exemplary embodiment illustrated in FIG. 3. Therefore, only the differences between these two exemplary embodiments will be described below.

In this exemplary embodiment, the fastening mechanism 206 may comprise three cylindrical shaped, industrial-type magnets which may have magnetic forces that exceed the strip or planar magnets of the other embodiments illustrated. That is, the pull force associated with the magnets of this FIG. 6A may exceed the pull force of the other exemplary embodiments. The pull force for the magnets for this exemplary embodiment as well as the other embodiments may range between 1.0 to 100.0 pounds of force. However, other magnitudes greater or less than this range are possible and are within the scope of this disclosure. Exemplary magnets include, but are not limited to, iron oxide, Ba- or Sr-carbonate, Mn—Al alloy, and Neodymium-iron-boron (NIB) type magnets.

Figure 7:
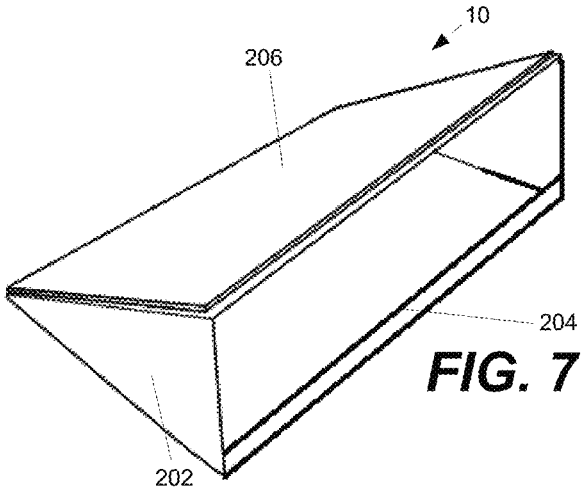
FIG. 7 illustrates another exemplary embodiment of a perspective view of an anti-theft mitigation device that may be part of the system for mitigating theft from a container, such as a safe.

Referring now to FIG. 7, this figure illustrates another exemplary embodiment of a perspective view of an anti-theft mitigation device 10 that may be part of the system 100 for mitigating theft from a container 16, such as a safe. The exemplary embodiment illustrated in FIG. 7 is similar to the exemplary embodiment illustrated in FIG. 6. Therefore, only the differences between these two exemplary embodiments will be described below.

According to this exemplary embodiment of FIG. 7, the anti-theft mitigation device 10 only has one lip or short wall 204 at the entrance of the cavity or volume defined by the anti-theft mitigation device 10. The fastening mechanism 206 may comprise a magnet which has a surface area which substantially matches a surface area of one side of the anti-theft mitigation device 10.

Figure 8:
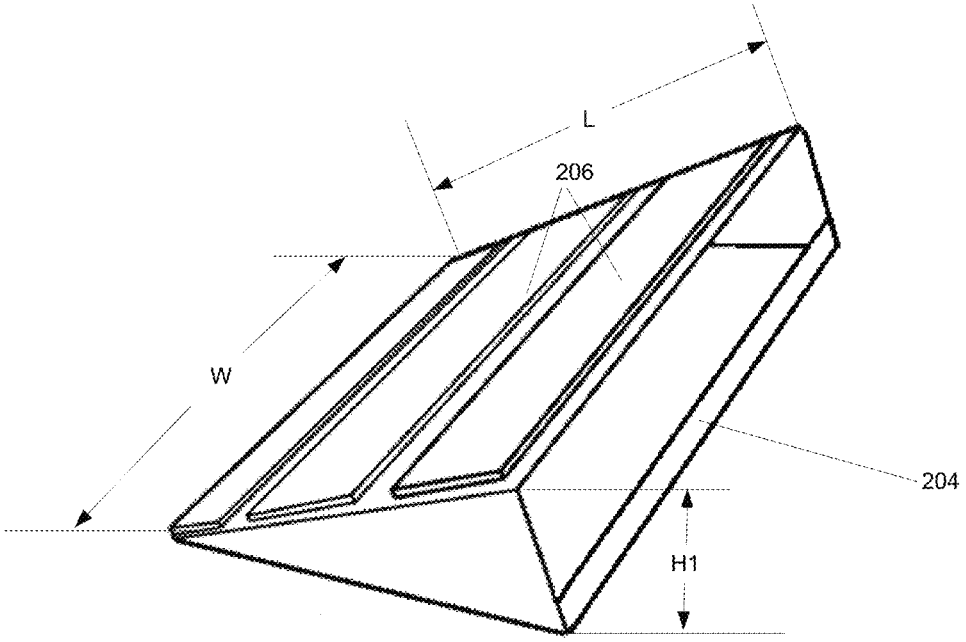
FIG. 8 illustrates another exemplary embodiment of a perspective view of an anti-theft mitigation device that may be part of the system for mitigating theft from a container, such as a safe.

Referring now to FIG. 8, this figure illustrates another exemplary embodiment of a perspective view of an anti-theft mitigation device 10 that may be part of the system 100 for mitigating theft from a container 16, such as a safe. The exemplary embodiment illustrated in FIG. 8 is similar to the exemplary embodiment illustrated in FIGS. 2-4. Therefore, only the differences between these exemplary embodiments will be described below.

The anti-theft mitigation device 10 of the exemplary embodiment illustrated in FIG. 8 will have a length dimension L, height dimension H2, and a width dimension W which are appropriate for smaller containers 16, such as hotel safes which are often part of other containers such as closets or walls of a hotel. Exemplary magnitudes for the dimensions of the anti-theft mitigation device 10 include, but are not limited to, those which would permit the anti-theft mitigation device 10 to be contained by a hotel safe having exemplary dimensions of approximately 8.0 inches for its length, approximately 14.0 inches for its width, and approximately 8.0 inches for its height. An exemplary hotel safe sold as of this writing with these dimensions is LockState™ brand safe, model 19EPL.

Figure 9:
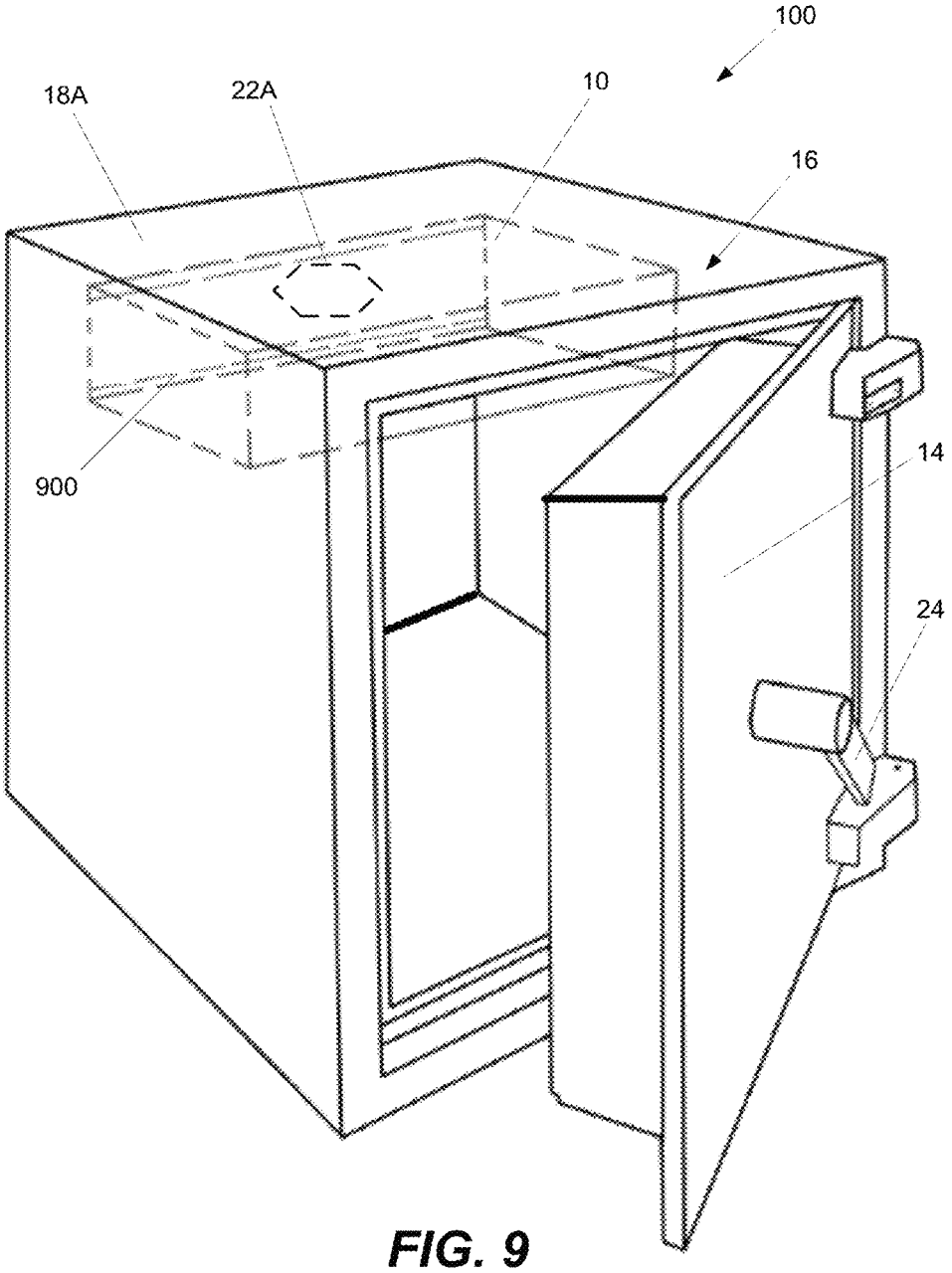
FIG. 9 illustrates another exemplary embodiment of a perspective view of a system for mitigating theft from a container, such as a safe.

Referring now to FIG. 9, this figure illustrates another exemplary embodiment of a perspective view of a system 100 for mitigating theft from a container 16, such as a safe. The exemplary embodiment illustrated in FIG. 9 is similar to the exemplary embodiment illustrated in FIG. 1. Therefore, only the differences between these two exemplary embodiments will be described below.

In the exemplary embodiment of FIG. 9, the anti-theft mitigation device 10 has a substantially rectangular or parallel-piped geometrical shape. This means that the cross-section of the anti-theft mitigation device 10 in this embodiment has a shape that is substantially rectangular. Another difference between this exemplary embodiment of FIG. 9 compared to the embodiment of FIG. 1 is that an opening for the anti-theft mitigation device 10 is on the side of the unit at reference numeral 900 compared to the "rear" opening of the wage embodiment illustrated in FIG. 1. Further details about this exemplary embodiment will be described below in connection with FIGS. 10-11.

Figure 10:
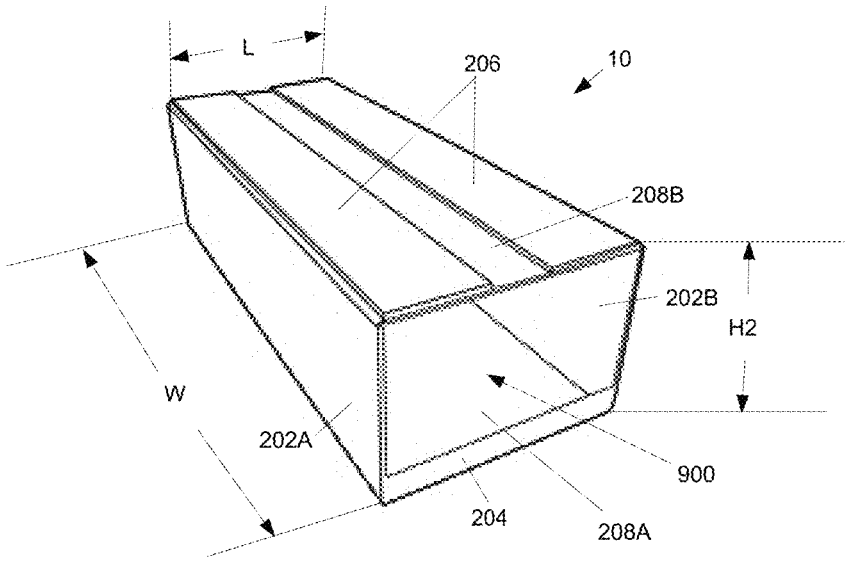
FIG. 10 illustrates another exemplary embodiment of a perspective view of an anti-theft mitigation device that may be part of the system for mitigating theft from a container, such as a safe.

FIG. 10 illustrates another exemplary embodiment of a perspective view of an anti-theft mitigation device 10 that may be part of the system 100 for mitigating theft from a container 16, such as a safe. FIG. 10 illustrates a side perspective view of the anti-theft mitigation device 10 that is presented in FIG. 9. The anti-theft mitigation device 10 has an opening 900 defined by the two pairs of walls 202A-B, 208A-B. This anti-theft mitigation device 10 has a fastening mechanism 206 which comprises two planar magnets which may have substantially equal surface areas.

The anti-theft mitigation device 10 of the exemplary embodiment illustrated in FIG. 10 will have a length dimension L, height dimension H2, and a width dimension W which are appropriate for containers 16, such as standard safes. Exemplary magnitudes for these dimensions include, but are not limited to, a length L of approximately 5.5 inches, a height H2 of approximately 4.0 inches, and a width W of approximately 14.0 inches. However, other magnitudes larger or smaller are possible and are included within the scope of this disclosure as understood by one of ordinary skill in the art.

Figure 11:
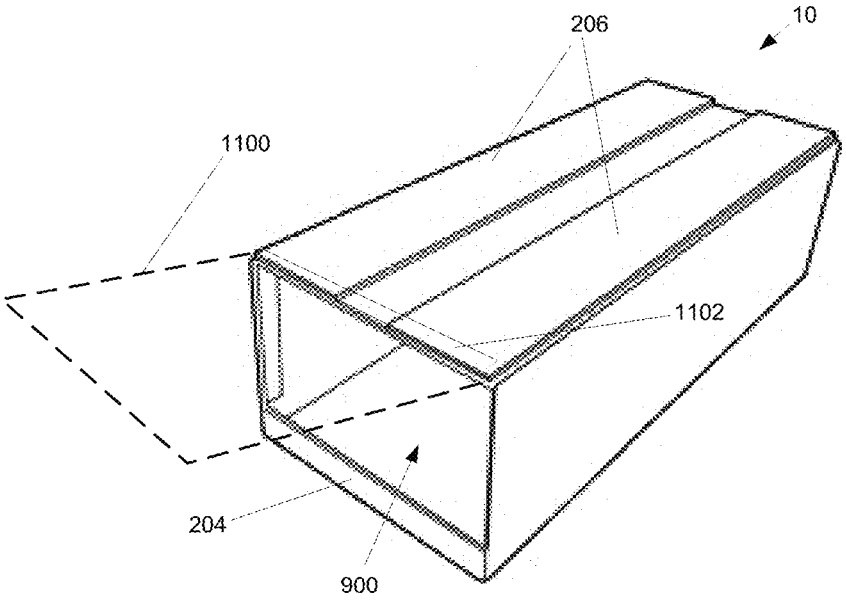
FIG. 11 illustrates another exemplary embodiment of a perspective view of an anti-theft mitigation device that may be part of the system for mitigating theft from a container, such as a safe.

Referring now to FIG. 11, this figure illustrates another exemplary embodiment of a perspective view of an anti-theft mitigation device 10 that may be part of the system 100 for mitigating theft from a container 16, such as a safe. The exemplary embodiment illustrated in FIG. 11 is similar to the exemplary embodiment illustrated in FIG. 10. Therefore, only the differences between these two exemplary embodiments will be described below.

According to this exemplary embodiment of FIG. 11, an optional door 1100 (illustrated with dashed lines) that is movable may be provided to cover the opening 900 at the end of the anti-theft mitigation device 10. This door 1100 may be coupled to the anti-theft mitigation device 10 by a hinge 1102. This door 1100 may be provided with a locking mechanism 20 (not illustrated) similar to the locking mechanisms described above in order to provide an added layer of security relative to the container 16. The optional door 1100 may be constructed from materials similar to the walls 202 and 208.

With the door 1100, the anti-theft mitigation device 10 may provide a volume which is completely sealed relative to the container 16 in which the anti-theft mitigation device that resides. Meanwhile, most of the exemplary embodiments described above usually provide the anti-theft mitigation device 10 with at least one opening such that the volume defined by the anti-theft mitigation device 10 is not completely sealed by the device 10 itself.

Figure 12:
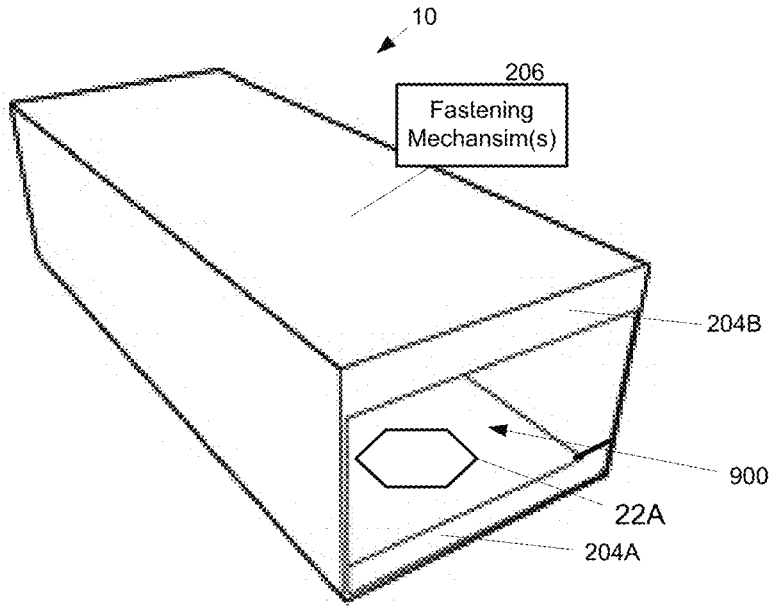
FIG. 12 illustrates another exemplary embodiment of a perspective view of an anti-theft mitigation device that may be part of the system for mitigating theft from a container, such as a safe.

FIG. 12 illustrates another exemplary embodiment of a perspective view of an anti-theft mitigation device 10 that may be part of the system 100 for mitigating theft from a container 16, such as a safe. The exemplary embodiment illustrated in FIG. 12 is similar to the exemplary embodiment illustrated in FIG. 10. Therefore, only the differences between these two exemplary embodiments will be described below.

According to this exemplary embodiment illustrated in FIG. 12, the anti-theft mitigation device 10 has both an upper lip 204B and a lower lip 204A that may prevent assets 22A from falling out of the opening 900 during movement of the device 10.

Similar to FIG. 6A, the fastening mechanism 206 of FIG. 12 has been represented by a functional rectangular box to indicate that any type of fastening mechanism may be employed with the anti-theft mitigation device 10 without departing from the scope of this disclosure. Exemplary fastening mechanisms 206 include, but are not limited to, hook and loop fasteners sold under the trademark VELCRO™, screws, nails, rivot, snaps, mating protuberance/channel-containing structures, mating male/female structures, and the like. The fastening mechanism 206 may comprise a hinge and hook system so that the anti-theft mitigation device 10 may rotate around the hinge when the hook is disengaged, where the hinge and hook are coupled to one side of an interior of the container 16.

Figure 13:
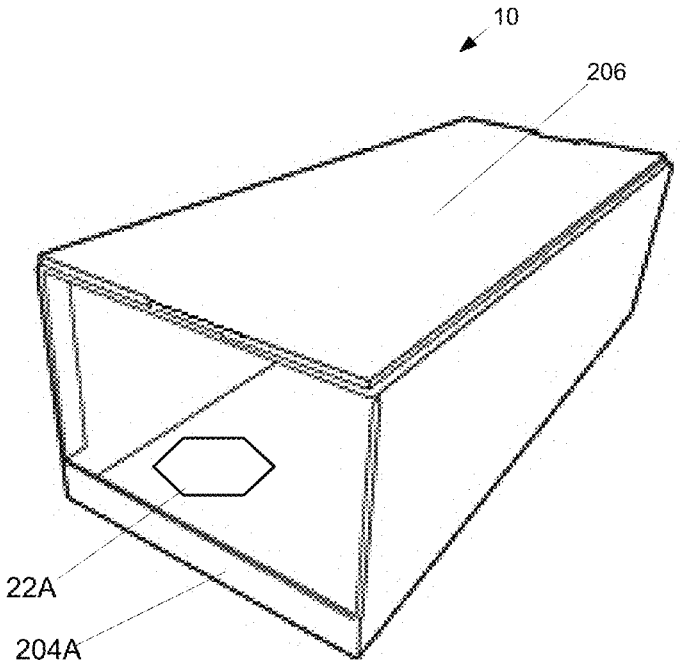
FIG. 13 illustrates another exemplary embodiment of a perspective view of an anti-theft mitigation device that may be part of the system for mitigating theft from a container, such as a safe.

Referring now to FIG. 13, this figure illustrates another exemplary embodiment of a perspective view of an anti-theft mitigation device 10 that may be part of the system 100 for mitigating theft from a container 16, such as a safe. The exemplary embodiment illustrated in FIG. 13 is similar to the exemplary embodiment illustrated in FIG. 10. Therefore, only the differences between these two exemplary embodiments will be described below.

According to this exemplary embodiment of FIG. 13, only a single lip 204A is provided to help prevent assets 22A from sliding out the of the anti-theft mitigation device 10. The fastening mechanism 206 for this exemplary embodiment comprises a single planar magnet that has a surface area which is substantially equal to or equivalent to one side of the anti-theft mitigation device 10.

Figure 14:
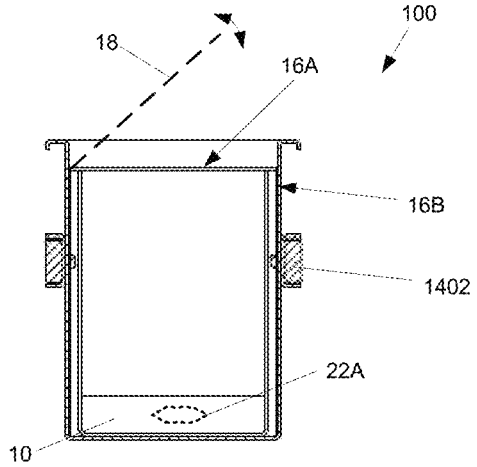
FIG. 14 illustrates a cross-sectional view of an exemplary embodiment of an anti-theft mitigation device that may be part of a system for mitigating theft from a container, such as a drawer safe or pawn drawer system.

Referring now to FIG. 14, this figure illustrates a side cross-sectional view of an exemplary embodiment of an anti-theft mitigation device 10 that may be part of a system 100 for mitigating theft from a container 16, such as a drawer safe or pawn drawer system. The system 100 of FIG. 14 may comprise a first drawer 16A, a second drawer 16B, and an anti-theft mitigation device 10 positioned on a lower portion relative to the first drawer 16A for protecting an asset 22. The first drawer 16A may comprise a wall or top portion 18 that may be opened as indicated with the dashed lines.

The second drawer 16B may comprise a drawer locking system 1402 that may permit only one wall or top portion 18 to be opened at any given time when a plurality of drawers 16 are coupled together to form a unit (see FIG. 16 described below). The anti-theft mitigation device 10 of this exemplary embodiment is provided with a height dimension relative to a height dimension of the first drawer 16A such that an ordinary observer may believe that the top portion of the anti-theft mitigation device 10 is the bottom portion of the first drawer 16A.

Of course, one of ordinary skill in the art appreciates that the "bottom" portion of the first drawer 16A is relative to the orientation in which the drawer system may operate. If the first drawer 16A was rotated ninety degrees clockwise, then the "bottom" portion may then be characterized as a "rear" portion relative to how the wall or top portion 18 is opened.

Figure 15:
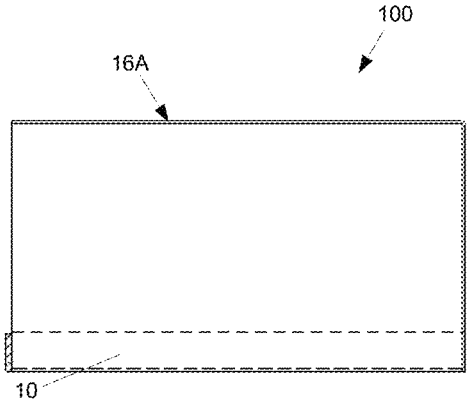
FIG. 15 illustrates an exemplary width dimension relative to the height dimension for the first drawer and anti-theft mitigation device as illustrated in FIG. 14.

Referring now to FIG. 15, this figure illustrates an exemplary side view of the first drawer 16A and the anti-theft mitigation device 10. The second drawer 16B is not illustrated in this figure.

FIG. 15 illustrates an exemplary width dimension relative to the height dimension for the first drawer 16A and anti-theft mitigation device as illustrated in FIG. 14. As FIGS.

14-16 illustrate, the first drawer 16A and the anti-theft mitigation device 10 have substantially rectangular shaped cross-sections and form parallel-piped three-dimensional geometries as understood by one of ordinary skill in the art. The relative sizes of these geometries as well as the actual shapes may be varied as understood by one of ordinary skill in the art without departing from the scope of this disclosure.

Figure 16:
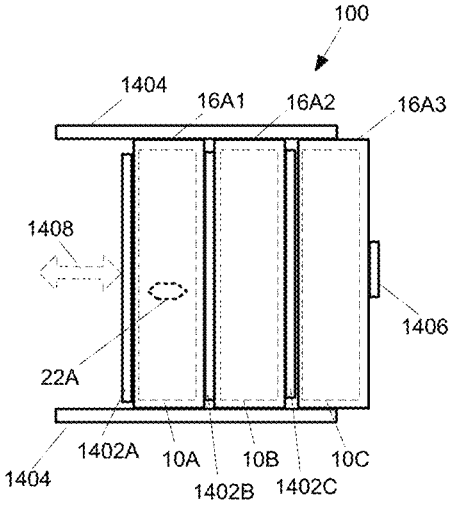
FIG. 16 illustrates a top or elevational view of an exemplary embodiment of an anti-theft mitigation device that may be part of a system for mitigating theft from a container, such as a drawer safe or pawn drawer system.

Referring now to FIG. 16, this figure illustrates a top or elevational view of an exemplary embodiment of an anti-theft mitigation device 10 that may be part of a system 100 for mitigating theft from a container 16, such as a drawer safe or pawn drawer system. The system 100 may comprise a drawer locking system 1402 that permits only one wall or top portion 18 of any first drawer 16A to be opened at any given time when a plurality of drawers 16A are coupled together to form a unit. In the exemplary embodiment illustrated in FIG. 16, three drawers 16A1-16A3 are illustrated. Also, the outer second drawer 16B for each first drawer 16A1-16A3 is not illustrated for clarity.

The three drawers 16A1-16A3 which each have a respective anti-theft mitigation device 10 may move in a lateral direction as indicated by directional arrow 1408. The three drawers 16A1-16A3 may be coupled to bearings 1404 which allow the three drawers 16A1-16A3 to slide when a handle 1406 is pulled or pushed by an operator. Each anti-theft mitigation device 10 of FIGS. 14-16 may comprise fastening mechanisms 206 and openings 900 as well as doors 1100 similar and/or identical to those as described above in connection with FIGS. 9-13.

Figure 17:
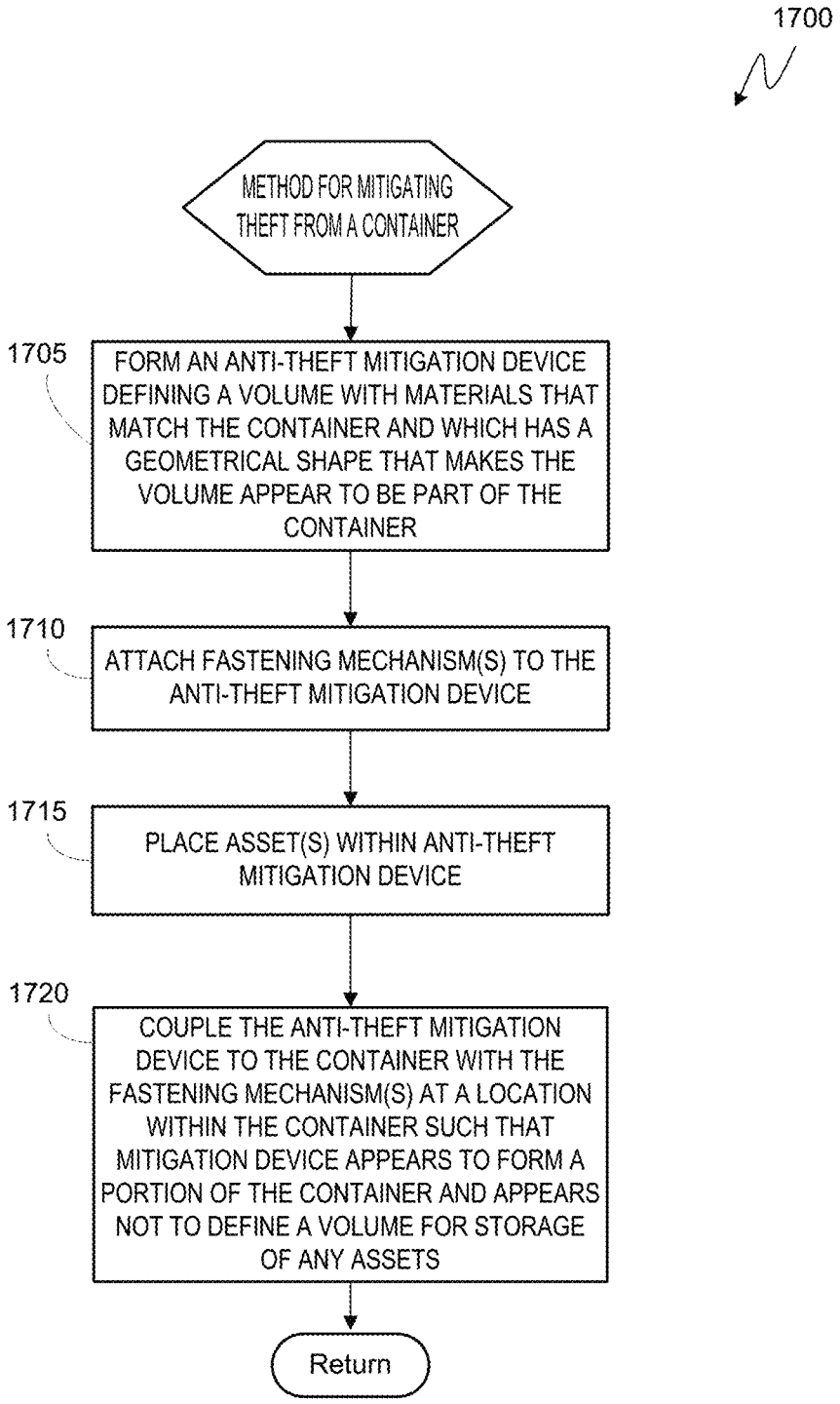
FIG. 17 is a flowchart illustrating a method for mitigating theft from a container, such as a safe or drawer system, according to one exemplary embodiment.

FIG. 17 is a flowchart illustrating a method 1700 for mitigating theft from a container, such as a safe or drawer system, according to one exemplary embodiment. Block 1705 is the first step of method 1700.

In block 1705, an anti-theft mitigation device 10 defining a volume with materials that match a container 16 and which has a geometrical shape that makes the volume appear to be part of the container 16 is formed. As described above in connection with FIGS. 1-16, the anti-theft mitigation device 10 may be formed from materials such as metal when the corresponding container 16 is also made from metal. As illustrated in FIGS. 1-8, the exemplary geometry of the anti-theft mitigation device 10 may comprise a triangular prism or wedge. As illustrated in FIGS. 9-16, the anti-theft mitigation device 10 may comprise a rectangular block.

In block 1710, fastening mechanisms 206 may be attached to the anti-theft mitigation device 10. When the container 16 is made from metal, the fastening mechanisms 206 may comprise one or more magnets so that the anti-theft mitigation device 10 may be coupled to the container 16 by the magnetic force generated by the one or more magnets. However, if the container 16 is made from other materials, such as wood, plastics, ceremics, cement, etc. other fastening mechanisms 206 may be employed. Other exemplary fastening mechanisms 206 besides magnets include, but are not limited to, hook and loop fasteners sold under the trademark VELCRO™, screws, nails, rivot, snaps, mating protuberance/channel-containing structures, mating male/female structures, and the like.

Next, in block 1715, one or more assets 22 may be placed within the volume defined by the walls of the anti-theft mitigation device 10. As described above, assets 22 may include, but are not limited to, cash (currency), precious gems, controlled substances, sensitive documents, firearms, chemicals, objects (i.e. artwork), electronics, etc.

Next in block 1720, the anti-theft mitigation device 10 may be coupled to the container 16 with the fastening mechanisms 206 at a location within the container 16 such that the mitigation device 10 appears to form a portion of the interior region of the container 16 and appears not to define a volume for storage of any assets 22.

As illustrated in FIGS. 1-8, the wedge-like shape of the anti-theft mitigation device 10 appears to form a bulkhead or top region of an interior region of the container 16. While FIG. 1 illustrates the anti-theft mitigation device 10 attached to a top portion/ceiling/top wall 18A of the container 16, the anti-theft mitigation device 10 may be easily attached to the side walls 18B,C or bottom wall 18D without departing from the scope of this disclosure.

In FIGS. 9-13, the anti-theft mitigation device 10 is illustrated with a rectangular block-like geometry that is attached to a top wall 18A of the container 16. The anti-theft mitigation device 10 may be easily attached to the side walls or bottom wall without departing from the scope of this disclosure.

In FIGS. 14-16, the anti-theft mitigation device 10 is illustrated with a compressed rectangular geometry and is positioned at a bottom or rear portion of a drawer container 16. In this exemplary embodiment, the anti-theft mitigation device 10 appears to form a bottom portion of the drawer system/container 16. After block 1720, the method 1700 returns.

Certain steps in the processes or process flows described in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Alternative embodiments will become apparent to one of ordinary skill in the art to which the invention pertains without departing from its spirit and scope. Therefore, although selected aspects have been illustrated and described in detail, it will be understood that various substitutions and alterations may be made therein without departing from the spirit and scope of the present invention, as defined by the following claims.

What is claimed is:

1. A system for mitigating theft from a container comprising:

a container having a plurality of walls defining a first volume, the container further comprising a single door through which provides access to the first volume;

a removable anti-theft mitigation device having a plurality of rigid walls defining a second volume;

a fastening mechanism attached to the removable anti-theft mitigation device, the anti-theft mitigation device being coupled to one of the plurality of walls of the container by the fastening mechanism, wherein the second volume of the removable anti-theft mitigation device is substantially smaller than the first volume of the container, the removable anti-theft mitigation device being positioned within the first volume and appearing to define a portion of the first volume, the removable anti-theft mitigation device being visible within the first volume and accessible when the single door for the container is opened, wherein the removable anti-theft mitigation device has a single opening through which to access one or more valuable objects, the removable anti-theft mitigation device comprises a rectangular three-dimensional geometry having a length dimension, width dimension, and a first height dimension; the width dimension being substantially greater than the first height dimension and length dimension, the length dimension being greater than the first height dimension; the length dimension and first height dimension defining a rectangular cross-sectional geometry for the rectangular three-dimensional geometry; the single opening being defined by the length and the first height dimension and positioned at one end of the rectangular three-dimensional geometry; the single opening comprising a lip that is positioned adjacent to a floor of the removable anti-theft mitigation device; the floor comprising one of the plurality of rigid walls of the removable anti-theft mitigation device which does not have a surface on which the fastening mechanism is attached; the lip comprising a second height dimension that is substantially less than the first height dimension of the rectangular three-dimensional geometry; the lip partially closing the single opening closest to the floor of the removable anti-theft mitigation device, the lip substantially preventing the one or more valuable objects from sliding out of the single opening of the three-dimensional geometry.

2. The system of claim 1, wherein the fastening mechanism comprises at least one of a magnet, a hook and loop fastener, a screw, a nail, a rivot, a snap, a mating protuberance, a channel-containing structure, a mating male or female mechanical structure.

3. The system of claim 1, wherein the container comprises at least one of a vault, a portable safe, a reinforced-fireproof cabinet, a document safe, an in-floor safe, a wall safe, a jewelry safe, and a gun safe.

4. The system of claim 1, wherein the container is made from at least one of metal, wood, cement, ceramics, glass, composites, polymers, and a combination thereof.

5. The system of claim 1, wherein the antitheft mitigation device comprises a material composition that substantially matches one or more materials that define an interior of the first volume.

6. An anti-theft mitigation system comprising:

a container having a plurality of walls defining a first volume, the container further comprising a single door through which provides access to the first volume; a removable anti-theft mitigation device comprising:

a plurality of rigid walls defining a second volume having a substantially triangular cross-section, the second volume comprising a single opening; and a fastening mechanism attached to one of the plurality of rigid walls, the fastening mechanism defining a substantially planar surface, the single opening existing on a side of the second volume which does not have the fastening mechanism and the side does not have a surface on which the fastening mechanism is attached, the wall on which the fastening mechanism is attached defining one side of the substantially triangular cross-section, the removable anti-theft mitigation device being coupled to one of the plurality of walls of the container by the fastening mechanism, wherein the second volume of the removable anti-theft mitigation device is substantially smaller than the first volume of the container, the removable anti-theft mitigation device being positioned within the first volume and appearing to define a portion of the first volume, the removable anti-theft mitigation device being visible within the first volume and accessible when the single door for the container is opened, the single opening permits access to one or more valuable objects, the removable anti-theft mitigation device comprises a substantially triangular three-dimensional geometry having a length dimension, width dimension, and a first height dimension; the width dimension being substantially greater than the first height dimension and length dimension; the length dimension being greater than the first height dimension; the length dimension, the width dimension and first height dimension defining a substantially triangular cross-sectional geometry for the substantially three-dimensional geometry; the single opening being defined by the width dimension and the first height dimension and positioned at one end of the substantially triangular three-dimensional geometry; the single opening comprising a lip that is positioned adjacent to a floor of the removable anti-theft mitigation device; the floor comprising one of the plurality of rigid walls of the removable anti-theft mitigation device which does not have a surface on which the fastening mechanism is attached; the lip comprising a second height dimension that is substantially less than the first height dimension of three-dimensional geometry; the lip partially closing the single opening closest to the floor of the removable anti-theft mitigation device; the lip substantially preventing the one or more valuable objects from sliding out of the single opening of the three-dimensional geometry.

7. The anti-theft mitigation system of claim 6, wherein the fastening mechanism comprises at least one of a magnet and a hook and loop fastener.

8. The anti-theft mitigation system of claim 6, further comprising a planar material positioned on an interior wall of the removable anti-theft mitigation device.

9. The anti-theft mitigation system of claim 8, wherein the removable anti-theft mitigation device is made from at least one of metal, wood, cement, ceramics, glass, composites, polymers, and a combination thereof.

10. The anti-theft mitigation system of claim 6, wherein the substantially triangular cross-section has at least one angle comprising approximately 90 degrees.

* * * * *